US006032394A

United States Patent [19]

Hand et al.

[11] Patent Number: 6,032,394

[45] Date of Patent: Mar. 7, 2000

[54] PLACARD HOLDER

[76] Inventors: Bill Hand; George Melnikoff, both of 6821A Johnston Rd., Pleasanton, Calif. 94588

[21] Appl. No.: 08/840,942

[22] Filed: Apr. 21, 1997

[51] Int. Cl.[7] ..... G09F 3/20

[52] U.S. Cl. ..... 40/651; 40/1.6; 40/329; 24/3.12; 24/654.01

[58] Field of Search ..... 40/1.5, 1.6, 329, 40/651, 652, 654.01, 661.04, 662; 24/3.12, 3.5; 2/195.1, 209.13, 244, 245, 246; 63/12, 20

[56] References Cited

U.S. PATENT DOCUMENTS

| | | | |
|---|---|---|---|
| 821,547 | 5/1906 | Stafford | 40/1.5 |
| 2,721,410 | 10/1955 | Davis | 2/195.5 |
| 2,834,129 | 5/1958 | Kirkbride | 40/1.5 |
| 3,425,100 | 2/1969 | Matney | 40/1.5 X |
| 3,430,829 | 3/1969 | Wilson et al. | 40/1.5 X |
| 4,509,277 | 4/1985 | Bolton . | |
| 4,691,457 | 9/1987 | Peroni | 40/1.6 X |
| 4,961,275 | 10/1990 | Klein . | |
| 4,985,935 | 1/1991 | Hur . | |
| 5,111,366 | 5/1992 | Rife | 2/209.13 X |
| 5,359,733 | 11/1994 | Brannon et al. . | |
| 5,359,734 | 11/1994 | Rathburn . | |
| 5,410,827 | 5/1995 | Smith . | |
| 5,418,981 | 5/1995 | Miner . | |
| 5,519,892 | 5/1996 | Pizzacar . | |

*Primary Examiner*—Brian K. Green
*Attorney, Agent, or Firm*—Medlen & Carroll, LLP

[57] ABSTRACT

A holder for fixing a placard to a body utilizing a mounting plate which confines the placard in a certain position. A multiplicity of pins are linked to the mounting plate and are capable of passing through the body. A backing member engages the pins through a plurality of apertures. The pins are held in place by a fixation member.

8 Claims, 3 Drawing Sheets

PLACARD HOLDER

BACKGROUND OF THE INVENTION

The present invention relates to a novel and useful holder for fixing a placard to a body.

Placards such as sports cards, identification cards, photos and the like are often desirous of being displayed by a user. In the past, application of mastic tape, safety pins, and the like have been employed to hold such placards to a body such as an article of clothing, a bulletin board, an article of furniture, and the like. Although these systems have been used on a temporary basis, there is a need for displaying placards efficiently and in a manner which exhibits versatility, permitting the placard to be moved from one body to another easily and simply. It is also important that the placard be protected from environmental effects and the normal wear and tear associated with contact of the placard by the user during the moving and fixing process.

U.S. Pat. Nos. 2,803,829, 4,452,479, 5,465,426, and 5,548,847, show structures for fixing photographs and the like to hats which generally employ a transparent member and a flap which is secured either to the inside or the outside of the hat.

U.S. Pat. No. 4,985,935 describes a cap visor which has a flap that raises and lowers to display a three dimensional item on the hat.

U.S. Pat. Nos. 5,359,733, 5,359,734, 5,418,981, and 5,519,892 show various ways to attach emblems to hats using hook and pile fasteners.

U.S. Pat. Nos. 4,509,277 and 5,410,827 teach badge holders which employ transparent plates and safety pin holders to fasten the same to a body.

U.S. Pat. No. 4,961,275 describes an identification badge which employs a plate having a pair of pins. The pins pass through a Velcro base and are held to clothing by a pair of locking members. The ultimate display is then able to be held to the garment by a rear portion which includes a mating Velcro structure, be it hook or pile.

A holder for fixing a placard to a body which is durable, and versatile would be a notable advance in the visual arts.

SUMMARY OF THE INVENTION

In accordance with the present invention a novel and useful holder for fixing a placard to a body is herein provided.

The body may take the form of an article of clothing, a bulletin board, a piece of furniture, and the like. In other words, any body may be employed which is capable of serving as a backdrop for a placard or a series of placards which may be mounted side-by-side thereupon. The body includes a first side and a second opposite side in the present system.

A mounting plate is employed in the present invention for confining the placard to be displayed thereto. Mounting plate may be a flexible, semi-rigid, or rigid body. In certain instances, the mounting plate may be formed with a chamber to allow the insertion and removal of the placard therefrom. In such a case, the mounting plate would include a transparent wall to permit viewing of the placard.

The holder also includes a multiplicity of pins each of which is capable of passing through the body first side for exposure at the second side thereof. The multiplicity of pins may be linked to the mounting plate in a suitable manner. For example, the pins may be directly connected to the mounting plate or may be linked to the mounting plate through an intermediate body, such as a frame, which will be described hereinafter.

A backing member is also found in the present holder and is positioned at the second side of the body. The backing member posses a plurality of apertures, each of the multiplicity of pins being capable of passing through one of the apertures.

Fixing means is also used in the present invention for preventing passage of the multiplicity of pins through the plurality of apertures of the backing member and from the second side of the body to the first side, thereof. Such fixing means may take the form of clips, caps, elastomeric bushings, and the like. In one embodiment of the present invention, the fixing means is constructed with a pair of bars and spring means connected to the same and lying intermediate the pair of bars. A tab or a pair of tabs, in the case where the spring means is a pair of springs, are connected to the spring means and deflect the springs when pushed or forced in a certain direction. Such deflection of the springs releases the bars from contact with the pins which lie at the second side of the body and the backing member apertures.

In another embodiment of the invention, a frame member may be employed to at least partially encompass the placard bearing mounting plate. In this fashion, the multiplicity of pins may be connected to the frame such that the linkage between the mounting plate and the multiplicity of pins is through the intermediate frame member. The frame member is then positioned on the first side of the body when the holder of the present invention has been secured to the body by the fixing means.

It may be apparent that a novel and useful holder for fixing a placard to a body has been described.

It is therefore an object of the present invention to provide a holder for fixing a placard to a body which is simple and easy to use with a body that is flexible, rigid, or semi-rigid.

Another object of the present invention is to provide a holder for fixing a placard to a body that easily permits interchangability of the placards as desired.

Yet another object of the present invention is to provide a holder for fixing a placard to a body that allows the display of the placard on a surface and is compatible with any number of such holders in side-by-side relationship.

A further object of the present invention is to provide a holder for fixing a placard to a body that includes fixing means which may be operated to simultaneously hold a multiplicity of pins in place, after penetration of the body, through the use of only one hand of the user.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS

Various aspects of the present invention will evolve from the following detailed description of the preferred embodiments which should be referenced to the hereinabove detailed drawings.

Figure 1:
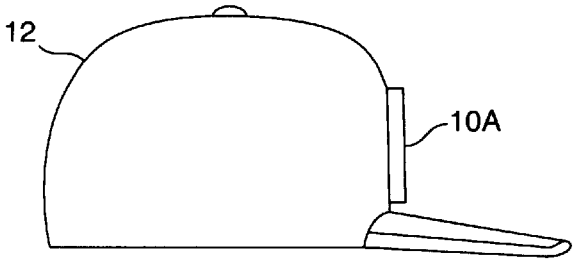
FIG. 1 is a side elevational view of the holder of the present invention mounted on a hat.
Figure 2:
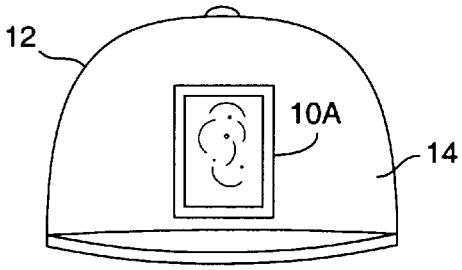
FIG. 2 is a front elevational view of the holder of the present invention mounted on a hat.

The invention as a whole is depicted in the drawings by reference character 10. Various embodiments of the invention are depicted by reference character 10 followed by an upper case letter. Holder 10 may be employed with any body that is capable of accepting the same. For example, FIGS. 1 and 2 depict holder 10A on a hat 12. Holder 10A is mounted on the front portion 14 of hat 12 for convenience. However, it should be realized that holder 10A may be placed anywhere on hat 12.

Figure 3:
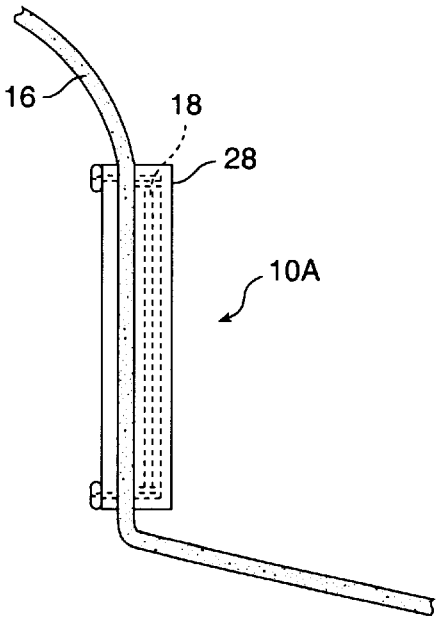
FIG. 3 is a sectional view of the holder of the present invention mounted on a body which is a flexible material.

With reference to FIG. 3 it may be observed that a body 16, which is a flexible body, is employed with holder 10A. In this regard, body 16 may also be rigid or semi-rigid to display single holders such as holder 10A or a group of holders in side-by-side configuration. The latter case might be described as a display board or similar article.

Figure 4:
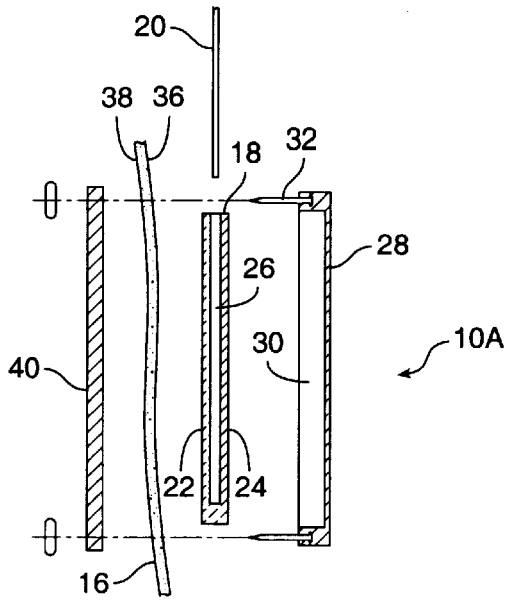
FIG. 4 is a sectional, exploded view of one embodiment of the holder of the present invention.
Figure 5:
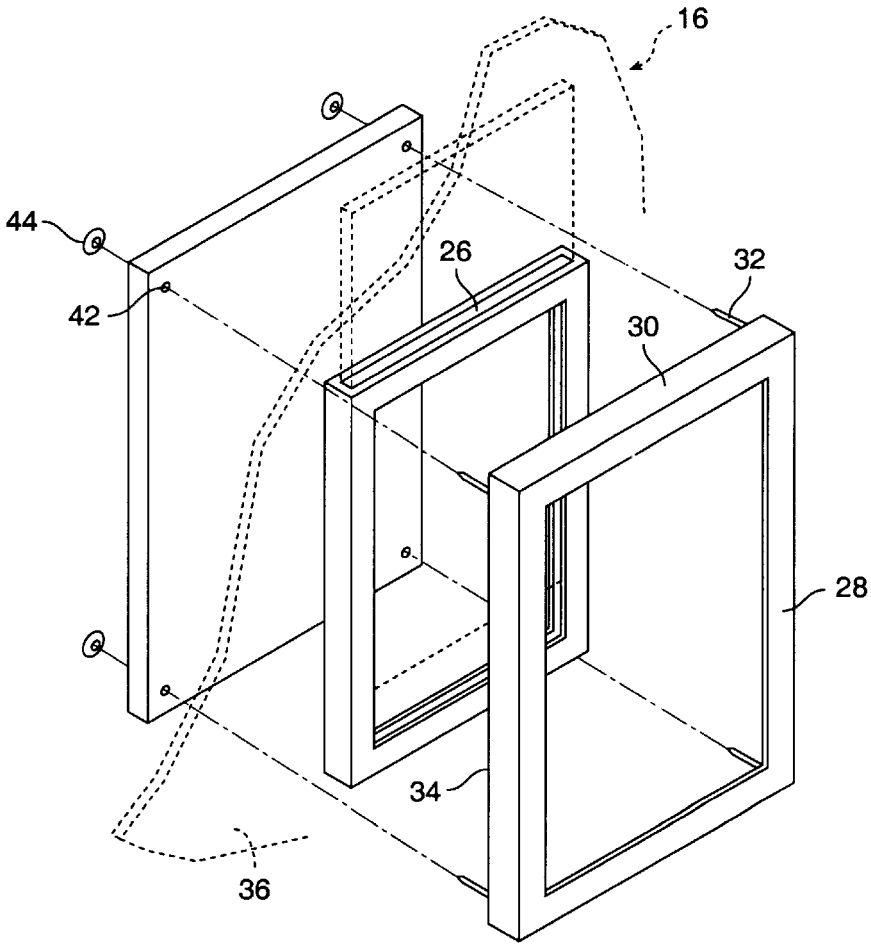
FIG. 5 is a top, left, exploded view of the embodiment depicted in FIG. 4.
Figure 6:
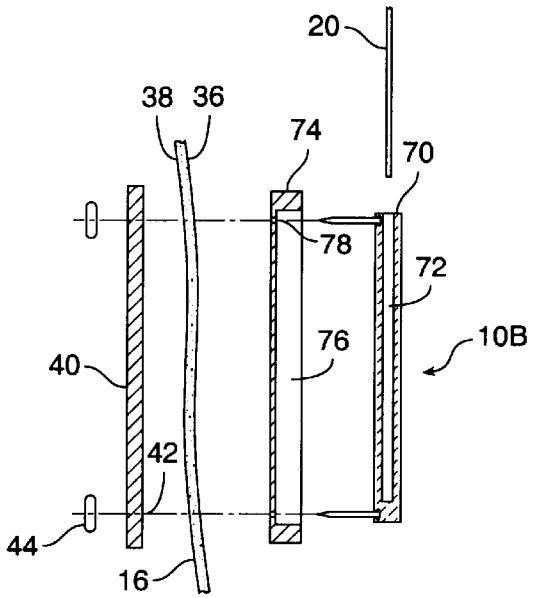
FIG. 6 is an exploded sectional view of another embodiment of the present invention.

The structure of embodiment 10A is best shown in FIGS. 4 and 5. Holder 10A includes as one of its elements a mounting plate placard 20 may be a business card, a sports card, a photograph, or anything having properties which make it desirous of being displayed. Mounting plate 18, in the embodiment shown in FIG. 4 is a transparent member having transparent walls 22 and 24 which define an inner chamber 26 for accommodating placard 20. It should be noted that mounting plate may provide other means of confining placard 20 thereto, such as lamination, gluing, and the like. In embodiment 10A, however, placard 20 is interchangeable relative to mounting plate 18.

Frame 28 includes a recess 30 which at least partially encompasses placard 20 when placard 20 and frame 28 are pressed against one another. Frame 28 includes a top surface 30 that covers the mouth 32 of chamber 26. Thus, placard 20 is not able to be removed from chamber 26 until frame 28 has been laterally spaced therefrom. Frame 28 is also constructed with a multiplicity of pins 32 that extend outwardly from edge 34 of frame 28. Multiplicity of pins 32 are capable of penetrating body 16. That is to say, multiplicity of pins 32 pass from first side 36 of body 16 to second side 38 such that multiplicity of pins 32 are exposed at second side 38 of body 16. Mounting plate 18 is thus linked to multiplicity of pins 32 by the encompassing frame 28.

Backing member 40 lies at second side 38 of body 16. Plurality of apertures 42 pass through backing member 40 and are sized to accept the passage of each of the multiplicity of pins 32. As depicted in embodiment 10A of FIGS. 4 and 5, a quartet of pins 32 and a quartet of apertures 42 are depicted. Backing member 40, which may be formed of any flexible, rigid, or semi-rigid material. Thus, in its assembled configuration, FIG. 3, holder 10A is generally in the form of a sandwich between backing member 40, placard 18, and frame 28.

Figure 7:
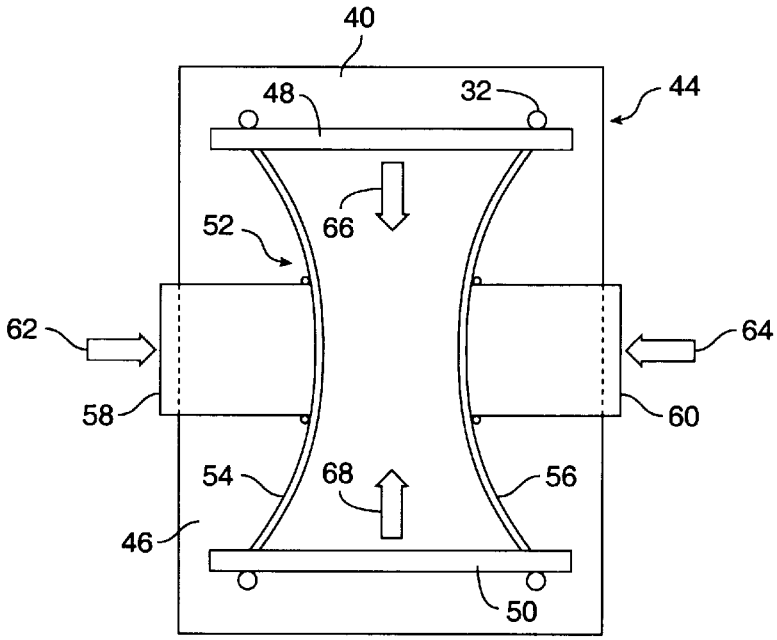
FIG. 7 is a rear elevational view of an embodiment of the fixing means of the present invention.
Figure 8:
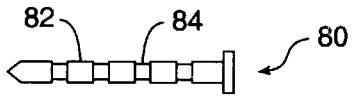
FIG. 8 is a side elevational view of an embodiment of the invention showing the structure of a pin which may be employed with the holder of the present invention.

Fixing means 44 serves to prevent the passage of multiplicity of pins 32 through plurality of apertures 42 from side 38 to side 36 of body 16. Fixing means 44 is shown in FIGS. 4–7 as a friction fitted bushing which engages any of the multiplicity of pins when any of the pins are exposed at second side 38 of body 16. With reference to FIGS. 7 and 8, it may be seen that fixing means 44 may take the form of engaging unit 46 having a pair of bars 48 and 50, connected to spring means 52 in the form of bowed strip springs 54 and 56. Tabs 58 and 60 are fastened to springs 54 and 56 by welding, gluing, or by formation of a unitary member. In any case, the movement of tabs 58 and 60 according to directional arrows 62 and 64 move bars 48 and 50 toward one another according to directional arrows 66 and 68. Bars 48 and 50 are normally in engagement with multiplicity of pins 32 passing through backing member 40 and are held in that position by the resiliency of springs 54 and 56. Pressing of tabs 58 and 60 frees multiplicity of pins 32 from bars 48 and 50.

Returning to FIG. 6, embodiment 10B is depicted in which a mounting plate 70 is shown in which multiplicity of pins 32 are held directly to the same. Backing member 40, identical to backing member 40 of FIG. 4, is used in conjunction with fixing means 44 to hold mounting plate 70 to body 16. Mounting plate 70 is fitted with a chamber 72 to hold placard 20, in a manner similar to that as depicted in FIG. 4. Frame 74 includes a recess for partially encompassing mounting plate 70 and includes a plurality of apertures 78 to permit the passage of multiplicity of pins therethrough. It should be noted that multiplicity of pins 32 also penetrate body 16 and backing member 40 in the same manner as that shown with respect to embodiment 10A of FIG. 4. It may also be apparent, that embodiment 10B permits the mounting plate 70 to be employed without frame 74 if so desired. That is to say, mounting plate 70 may lie directly against first side 36 of body 16 without an intermediate frame 74.

FIG. 8 depicts a pin 80 which includes a shaft 82 having a plurality of groves 84 therealong. Pin 80 may be a structure constituting any one of multiplicity of pins 32 and would be especially useful with respect to engaging unit 46 shown in FIG. 7.

In operation, the user places placard 20 in conjunction with mounting plate 18 of holder 10A or mounting plate 70 of holder 10B. In the embodiments depicted, placards 20 would enter chambers 26 or 72 of mounting plates 18 and 70, respectively. Mounting plate 18 containing placard 20 would then be placed within frame 28 of embodiment 10A, and pins 32 would pass through body 16, and to plurality of apertures 42 of backing member 40. Fixing means 44 would then be employed to hold these components in a sandwich configuration. Embodiment 10B may be mounted to body 16 simply by using multiplicity of pins 32 to penetrate body 16 and pass through the plurality of apertures 42 of backing member 40. Again, fixing means 44 would engage multiplicity of pins on the side of backing member 40. In addition, frame 74 may be employed with embodiment 10B to present a more protected holder such that frame 74 lies intermediate body 16 and mounting plate 70 in a sandwich configuration.

The embodiments of the present invention have been set forth in considerable detail for the purposes of making a complete disclosure of the invention, it may be apparent to those of skill in the art that numerous changes may be made in such details with out departing from the spirit and principals of the invention.

What is claimed is:

1. A holder for fixing a free placard to a body having a first side and an opposite second side comprising:

a. a mounting plate, said mounting plate including a chamber for confining said placard and for displaying said placard for viewing;

b. a multiplicity of pins, each of said multiplicity of pins dimensioned to pass through the body from the first side of the body to the second side of the body for exposure thereat, said multiplicity of pins linked to said mounting plate;

c. a backing member including a plurality of apertures, each of said multiplicity of pins passing through one of said plurality of apertures; and d. fixing means for preventing passage of said multiplicity of pins through said plurality of apertures of said backing member, said fixing means comprising a bar and spring means for forcing contact of said bar with said multiplicity of pins.

2. The holder of claim 1 which additionally includes a frame member at least partially encompassing said mounting plate, said multiplicity of pins being connected to said frame for linkage to said mounting plate thereby.

3. The holder of claim 2 in which said multiplicity of pins are connected to said frame.

4. The holder of claim 3 in which said frame includes a recess for at least partially encompassing said mounting plate.

5. The holder of claim 1 in which said multiplicity of pins are connected to said mounting plate.

6. The holder of claim 1 in which said bar is a first bar and said fixing means further comprises a second bar, said spring means biasing said first and second bars into contact with said multiplicity of pins.

7. The holder of claim 6 in which said fixing means further includes a tab connected to said spring means such that exertion of a force on said tab deflects said spring means.

8. The holder of claim 7 in which said spring means comprises a pair of springs each connected to said first and second bars.

* * * * *